US005622203A

United States Patent [19]

Givler et al.

[11] Patent Number: 5,622,203

[45] Date of Patent: Apr. 22, 1997

[54] HOT WATER CIRCULATION APPARATUS WITH ADJUSTABLE VENTURI

[75] Inventors: John D. Givler, Avon Lake; Erwin F. Mikol, Westlake, both of Ohio

[73] Assignee: Moen Incorporated, North Olmsted, Ohio

[21] Appl. No.: 538,586

[22] Filed: Oct. 3, 1995

[51] Int. Cl.[6] ..... F24H 1/00

[52] U.S. Cl. ..... 137/337; 137/893; 137/895; 126/362

[58] Field of Search ..... 126/362; 137/337, 137/892, 893, 895

[56] References Cited

U.S. PATENT DOCUMENTS

| | | | |
|---|---|---|---|
| Re. 25,037 | 9/1961 | Brazier | 137/895 |
| 2,233,965 | 3/1941 | Strovink | 137/892 |
| 2,265,108 | 12/1941 | Berman | 126/362 |
| 2,842,155 | 7/1958 | Peters | 137/337 |
| 2,873,758 | 2/1959 | Nielsen | 137/895 |
| 3,598,288 | 8/1971 | Posgate | 137/892 |
| 3,870,228 | 3/1975 | Moseley, Jr. | 126/362 |
| 3,929,153 | 12/1975 | Hasty | 137/337 |
| 4,951,713 | 8/1990 | Jordan et al. | 137/895 |
| 5,183,029 | 2/1993 | Ranger | 126/362 |
| 5,323,803 | 6/1994 | Blumenauer | 137/337 |
| 5,331,996 | 7/1994 | Ziehm | 137/337 |

FOREIGN PATENT DOCUMENTS

| | | | |
|---|---|---|---|
| 229012 | 4/1958 | Australia | 137/895 |
| 837336 | 3/1952 | Germany | 137/895 |

*Primary Examiner*—A. Michael Chambers

*Attorney, Agent, or Firm*—Dorn, McEachran, Jambor & Keating

[57] ABSTRACT

A dual mode water circulation apparatus for installation in a water supply line in a building upstream of a water heater provides continuously heated water at one or more remote hot water faucets. The apparatus is connected in a water return loop that includes a portion of the water supply line that is downstream of the apparatus, the water heater, the common hot water pipe, and a return line from a remote faucet. The apparatus includes a housing having a first inlet for connection to the water return line, an outlet for connection to that portion of the water supply line that connects to the water heater, and a second inlet for connection to the water supply line. There is a chamber in the housing with the inlets and outlet connecting to the chamber. There is a check valve between the first inlet and the chamber preventing flow from the apparatus outwardly from the first inlet. A venturi is positioned in the chamber to provide reduced pressure adjacent the first inlet to cause an increase in flow in the water return loop when water flows into the apparatus from the water supply pipe. There is a variable capacity bypass connected about the venturi and between the second inlet and the outlet to control water pressure at the first inlet which controls the flow of water in the water return loop.

13 Claims, 1 Drawing Sheet

HOT WATER CIRCULATION APPARATUS WITH ADJUSTABLE VENTURI

THE FIELD OF THE INVENTION

The present invention relates to a dual mode hot water circulation apparatus of the type shown in U.S. Pat. No. 5,331,996. Such an apparatus is designed to provide essentially instantaneous hot water at one or more remote water faucets which are connected in a return loop with the water heater. In the '996 patent there is a heat exchanger which is utilized to insure convective flow of water within the water return loop, even when no faucet or other water supply apparatus is being operated. However, such a heat exchanger has been found not to be necessary to insure convective flow in either of the two modes in which the water circulation apparatus operates. The present invention not only provides a dual mode water circulation apparatus without the use of a heat exchanger, but includes a bypass around the venturi in the water circulation apparatus which allows the homeowner to regulate the flow of water in the return loop which permits control of the temperature of the water available at the hot water faucets, when such are turned on. The water user, by the means of the adjustable flow or adjustable capacity bypass, has the ability to tailor water flow in the return loop to meet the hot water needs of the building consistent with the water pressure that is available at the inlet supply line.

The invention further relates to the concept of an adjustable aspirator or venturi which provides for regulation of the flow through a water supply loop by the adjustment of the capacity of a bypass about the venturi.

SUMMARY OF THE INVENTION

The present invention relates to an apparatus for providing water circulation within a building so that there is essentially instantaneous hot water at hot water faucets.

A primary purpose of the invention is a dual mode hot water circulation apparatus which provides for adjustment by the building owner of the water temperature at the point of use consistent with the needs of the building user and the water pressure available at the water supply line.

Another purpose of the invention is to provide an adjustable venturi utilizing a bypass about the venturi, thereby controlling the pressure at the venturi inlet.

Another purpose is a water circulation apparatus which is simple in construction, reliably operable and adjustable to provide hot water at a desired location consistent with inlet water pressures.

Other purposes will appear in the ensuing specification, drawings and claims.

BRIEF DESCRIPTION OF THE DRAWINGS.

The invention is illustrated diagrammatically in the following drawings wherein.

DESCRIPTION OF THE PREFERRED EMBODIMENT

Figure 1:
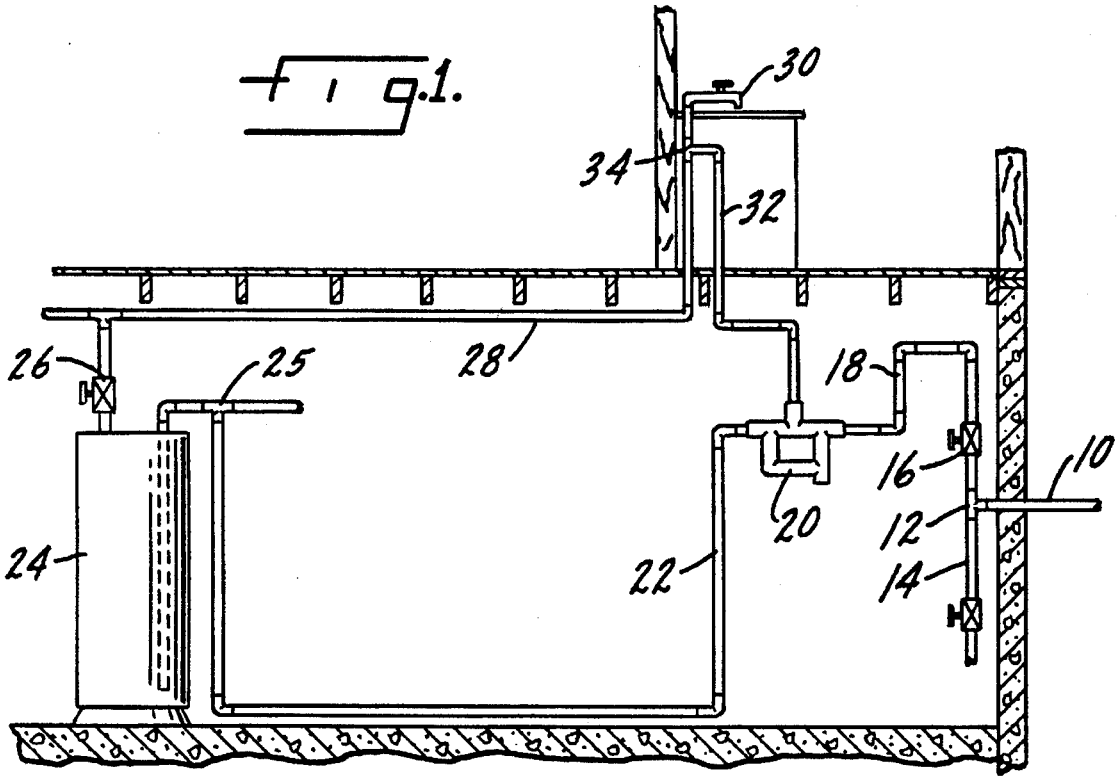
FIG. 1 is a diagrammatic illustration of a residential hot water system showing the placement of the water control apparatus of the present invention.

The present invention relates to a dual mode water control apparatus which can be installed within the water system of a building, for example a residence, to create a water circulation loop which has the effect of providing substantially instantaneous hot water at one or more faucets which are located remotely from the hot water heater. Focusing on FIG. 1, the water inlet supply for the building is indicated at 10 and will connect to a tee 12. The bottom pipe 14 connected to the tee 12 may provide water to other plumbing fixtures related to the building, either inside or out. There is a shutoff valve 16 connected at the top outlet of the tee 12, with the shutoff being connected to a pipe 18 which connects to one inlet of the water control apparatus 20. The outlet from the apparatus 20 connects to a pipe 22 which provides the inlet water supply for a water heater 24. There may be a second tee connection 25 at the inlet of the heater 24 which will provide water to other appliances or fixtures within the building.

The outlet from the water heater 24 goes through a shutoff valve 26 and connects to a pipe 28. The pipe 28 provides hot water to a faucet 30. There is a water return pipe 32 connected at a tee 34 just below the faucet 30 that carries water back to the water flow control apparatus 20. There is a water return loop shown in FIG. 1 which includes the flow control apparatus 20, the inlet pipe 22 for the water heater, the water heater itself, the water pipe 28, and the return pipe 32. These elements, as connected, provide a water return path in which there will be constantly circulating hot water which will maintain the water at faucet 30 at a substantially elevated temperature, suitable for hot water discharge. Pipe 28 may supply several hot water faucets and return pipe 32 will be connected at the most remote of the hot water faucets in the return loop.

The apparatus 20 includes a housing 36 having an outlet 38 which connects to pipe 22. The housing 36 has an inlet 40 which connects to inlet pipe 18 and it has an inlet 42 which connects to return pipe 32. Within the housing 36 there is a chamber 44 which is in communication with the outlet 38 and the inlets 40 and 42. Positioned within the chamber 44 is a venturi 46 which has its inlet side in communication with inlet 40 and its outlet directly adjacent the outlet 38. The venturi 46 consists of the cone-shaped inlet element 47 and a downstream outlet element 49 connected by a reduced diameter throat 45. The throat 45 is separated from the inlet element 47 by a gap 51 which communicates with the outlet 48 of inlet 42. The purpose of the throat 45 is to create an area of low pressure as water flow through it, as contrasted to the pressure at the inlet side in chamber 44 and the outlet 38, to thus draw water from the inlet connection 42 which is connected to the water return pipe 32.

Positioned within the connection between the inlet 42 and the outlet 48 is a check valve 50 which normally will permit water flow in the direction of arrow 52, when it is flowing as a part of the return loop described above. The check valve will not permit water flow in the opposite direction. There is a conical valve seat 54 in the inlet connection 42 and the check valve 50 has a conical nose 56. The check valve 50 will be constructed of a material having a specific gravity of slightly more than 1.0. Water attempting to flow out of inlet 42 will move the check valve to a closing position with seat 54.

There is a bypass about the venturi 46 formed by a conduit 58 which has an inlet opening 60 adjacent the inlet 40 and an outlet 62 between the downstream end of the venturi 46 and the housing outlet 38. Positioned within the conduit 58 is a check valve 64 to mate against a valve seat 68 adjacent bypass inlet 60. The check valve 64 is seated upon a coiled spring 70 with the spring force applied to the check valve being controlled by a plug 72 which can be adjusted from outside of the housing 36 to vary the spring pressure upon the bypass plug 64. Flow through the venturi will cause a pressure drop or differential from inlets 40, 60 to outlet 62 and will move the check valve 64 to the position shown which permits a bypass of some of the inlet water flow around the venturi. The force on the spring 70 from the position of plug 72 will control the position of check valve 64 to thus vary the amount of water which flows through the bypass 58. Since the amount of water flowing through the bypass will determine the downstream pressure of the venturi 46 at outlet element 49, the position of plug 64 will thus control the volume of water flowing through the hot water supply loop as described hereinafter.

The water circulation apparatus 20 provides a flow of hot water under two different modes of operation. When no water appliance is open, and thus there would normally be no flow of hot water, gravity plus the cooling of the water within pipe 32 is sufficient to create a convective flow of water in the return loop made up of pipe 32, apparatus 20, pipe 22, hot water heater 24, and pipe 28. This modest convective flow of water will maintain heated water at the inlet of faucet 30. The water in this path of flow will follow arrow 52 into the apparatus 20, with the water flowing past check valve 50 and through outlet 38. The venturi has no effect on such water flow in that mode of operation in which no water appliance has been turned on and thus there is no inlet flow of water into the apparatus 20 from pipe 18.

When there is flow at inlet 40, there is a pressure drop at the venturi throat 45 with the result that the pressure at outlet 48 adjacent the venturi gap 51 will be lower than the water pressure at inlet 42. This will cause a faster circulation of water or a greater rate of flow in the described return loop. Thus, the flow at the inlet of the apparatus 20, in the second mode of operation, will accelerate the flow of hot water in the return loop. However, it is desirable to be able to control the hot water temperature at a faucet 30. This temperature may vary as the water circulation flow varies and the water circulation flow may vary with the flow at the inlet supply in pipe 18 connected to inlet 40. Thus, the check valve 64 may be used to bypass a portion of the inlet supply around the venturi so as to decrease the pressure drop across the venturi. This has the effect of lowering the rate of flow in the hot water return loop. The position of the check valve, which is controlled by spring 70, as adjusted by plug 72, can thus vary the rate of water flow in the hot water return loop to give the user of the appliance a selected hot water temperature at a faucet 30. The adjustment of check valve 64 can be easily done by the building or homeowner to suit the particular hot water needs at the one or more faucets which will be connected within the return loop. Normally, the line 32 will be returning water from the most remote hot water faucet within the loop.

Figure 2:
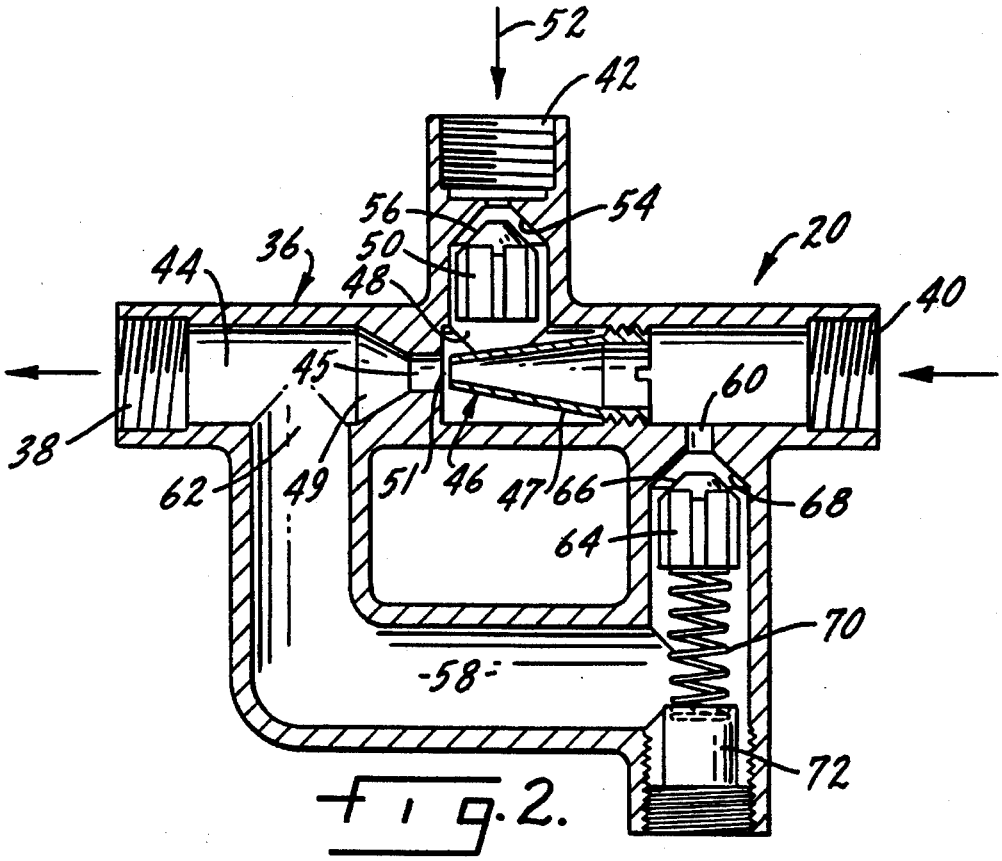
FIG. 2 is a section through the water control apparatus.

The adjustable venturi with the bypass shown in FIG. 2 has wider application than in the dual mode hot water circulation apparatus described. There are various other hydraulic flow control systems utilizing venturis to promote the flow of fluid. The use of an adjustable capacity bypass has application in any such hydraulic system.

Whereas the preferred form of the invention has been shown and described herein, it should be realized that there may be many modifications, substitutions and alterations thereto.

The embodiments of the invention in which an exclusive property or privilege is claimed are defined as follows:

1. A dual mode water circulation apparatus for installation in a water supply line in a building upstream of a water heater to provide continuously heated water to one or more remote hot water faucets served by a common hot water pipe, the apparatus being connected in a water return loop that includes a portion of the water supply line that is downstream of the apparatus, the water heater, the common hot water pipe, and a return line from a remote faucet, said apparatus including a housing having a first inlet for connection to the water return line, an outlet for connection to that portion of the water supply line that connects to the water heater, and a second inlet for connection to the water supply, a chamber in said housing with said inlets and outlet connecting to said chamber, a check valve between said first inlet and said chamber preventing flow from said apparatus outwardly from said first inlet, a venturi in said chamber to cause reduced pressure adjacent said first inlet to cause an increase in flow in said water return loop when water flows into said apparatus from said water supply pipe, and a variable capacity bypass connected about said venturi and between said second inlet and said outlet to control water pressure at said first inlet and thus the flow of water in said water return loop, said bypass including a water conduit connected between said second inlet and said outlet, a check valve in said conduit and yielding means urging said check valve toward a conduit closing position.

2. The apparatus of claim 1 wherein said water conduit includes an opening adjacent to said second inlet, said check valve being positioned in said conduit downstream of said opening.

3. The apparatus of claim 1 wherein said yielding means includes a spring positioned in said conduit and biasing said check valve toward said opening.

4. The apparatus of claim 1 wherein said spring includes a coil spring positioned within said conduit.

5. The apparatus of claim 1 including means for varying the force applied by said spring to said check valve to provide for variable capacity flow through said bypass.

6. The apparatus of claim 1 wherein the means for varying the force applied by said spring on said check valve includes a plug, said spring being seated on said plug, and means for adjustably moving said plug from outside of said housing.

7. An adjustable flow control apparatus including a housing, a chamber within said housing, a first inlet in said housing connected to said chamber and a check valve preventing reverse flow outwardly from said first inlet, an outlet in said housing connected to said chamber, a second inlet in said housing connected to said chamber, a venturi having an inlet side and an outlet side positioned in said chamber between said second inlet and said outlet, said venturi providing an area of reduced pressure adjacent, and a variable capacity bypass connected about said venturi and between said second inlet and said outlet to control water pressure at said first inlet to thereby control the flow of water from said first inlet to said outlet, said bypass including a water conduit connected between said second inlet and said outlet, a check valve in said conduit and yielding means urging said check valve toward a conduit closing position.

8. The apparatus of claim 7 wherein said bypass includes a water conduit connected between said second inlet and said outlet, a check valve in said conduit and yielding means urging said check valve toward a conduit closing position.

9. The apparatus of claim 8 wherein said water conduit includes an opening adjacent to said second inlet, said check valve being positioned in said conduit downstream of said opening.

10. The apparatus of claim 9 wherein said yielding means includes a spring positioned in said conduit and biasing said check valve toward said opening.

11. The apparatus of claim 10 wherein said spring includes a coil spring positioned within said conduit.

12. The apparatus of claim 10 including means for varying the force applied by said spring to said check valve to provide for variable capacity flow through said bypass.

13. The apparatus of claim 11 wherein the means for varying the force applied by said spring on said check valve includes a plug, said spring being seated on said plug, and means for adjustably moving said plug from outside of said housing.

* * * * *